United States Patent [19]

Zimmerman et al.

[11] 4,355,229

[45] Oct. 19, 1982

[54] INTENSIFIED CHARGE COUPLED IMAGE SENSOR HAVING UNIVERSAL HEADER ASSEMBLY

[75] Inventors: Harlan S. Zimmerman, Columbia; James L. Rhoads, Lancaster, both of Pa.

[73] Assignee: RCA Corporation, New York, N.Y.

[21] Appl. No.: 211,350

[22] Filed: Nov. 28, 1980

[51] Int. Cl.[3] ..... H01J 31/50

[52] U.S. Cl. ..... 250/213 VT; 313/102

[58] Field of Search ..... 250/211 R, 211 J, 213 R, 250/213 VT, 578, 331, 332; 357/24, 32; 313/98, 102, 97

[56] References Cited

U.S. PATENT DOCUMENTS

| | | | |
|---|---|---|---|
| 3,887,810 | 6/1975 | Skaggs | 250/213 VT |
| 3,925,657 | 12/1975 | Levine | 250/211 J |
| 3,937,964 | 2/1976 | Muehllehner | 250/213 VT |
| 4,010,319 | 3/1977 | Levine | 357/24 |
| 4,178,528 | 12/1979 | Kennedy | 313/102 |
| 4,178,529 | 12/1979 | Kennedy | 313/102 |

OTHER PUBLICATIONS

"Camera Tube Objective Data—C21205" by RCA Electro Optics and Devices, Mar. 1979.

"Guidelines for Designing Multilayer Ceramic Substrates" by 3M Electronic Products Division.

*Primary Examiner*—David C. Nelms

*Attorney, Agent, or Firm*—Eugene M. Whitacre; Dennis H. Irlbeck; Vincent J. Coughlin, Jr.

[57] ABSTRACT

An intensified charge coupled image sensor comprises an inverter image intensifier tube having an evacuated envelope with a longitudinally extending optical axis. The sensor has a photoemissive cathode and a charge coupled device spaced from the cathode. The charge coupled device includes an A register, a B register, a C register and a plurality of electrodes disposed on a surface thereof. The charge coupled device is resiliently held by a holder plate which has an imaging aperture therethrough. In the preferred embodiment, the imaging aperture is centered about the optical axis and permits electron emission from the cathode to impinge upon at least a portion of the A and B register. Other imaging aperture configurations limit electron impingement to a single column of pixels in the A and B registers and to the A register only. A universal header having a header aperture with a center slightly displaced in at least one dimension from the optical axis of the sensor accommodates a holder plate having any one of the aforementioned imaging aperture configurations. A plurality of electrical contact pads are disposed on one surface of the header. The number of contact pads exceeds the number of electrodes required for the operation of the charge coupled device with any one particular imaging aperture; however, the header has a sufficient number of contact pads to accommodate any of the above-mentioned imaging aperture configurations.

16 Claims, 7 Drawing Figures

INTENSIFIED CHARGE COUPLED IMAGE SENSOR HAVING UNIVERSAL HEADER ASSEMBLY

BACKGROUND OF THE INVENTION

The present invention relates to an intensified charge coupled image sensor and particularly to a universal header assembly for such a sensor that permits the sensor to be operated in one of a number of preselected modes.

In prior art intensified charge coupled image sensors, such as the RCA C21205 silicon-intensifier target/-charge coupled device (SIT/CCD) camera tube, only an image area or "A" register of the charge coupled device is exposed to the electrons emitted from the photocathode of the intensifier section of the camera tube. A storage area or "B" register and a horizontal output register or "C" register are masked to prevent the electrons from the photocathode from impinging thereon. It is known that in electrostatically focused intensified charge coupled image sensors, such as the RCA C21205 shown in FIG. 1, the lateral magnification of the output image increases from about 1.00 at the center of the image or focal plane (located orthogonal to the optical axis) to about 1.10 at the edge with a nominal value of about 1.03 at 12 mm from the center. This increasing lateral magnification introduces "pincushion" distortion in the image plane that can be minimized and equalized by centering the image or "A" register about the optical axis.

The RCA C21205 SIT/CCD camera tube uses a CCD imager commercially available from RCA Corporation as SID 52501 (formerly 51232) and known as "Big Sid". "Big Sid", represented schematically in FIG. 2, is three-phase operated and has 320 columns and 512 rows (256 in the A register and 256 in the B register) thus providing 81,920 (320×256) pixels in the A register for imaging purposes. While not shown in the FIGURES, the imaging area of the CCD is thinned to a thickness of about 8–10 microns.

The operation of the tube of FIG. 1 is well understood. During the so-called integration time, a scene or other image is projected onto an input faceplate of the tube. The light or other incident radiation of the image causes electrons to be emitted, in a pattern corresponding to the intensity of incident radiation, from a photoemissive cathode formed on the interior surface of the faceplate. A potential difference, established between the cathode and a charge coupled device (CCD), accelerates the electrons to a higher energy during the transit from the cathode to the CCD. The emitted electrons are focused by potentials applied to internal image tube components to form an inverted electron image on the imaging register of the CCD. The impinging electrons cause electron-hole pairs to be created at the various locations in the A register in accordance with the electron density reaching the respective locations. The charges, representing picture-element signals, are stored in potential wells under depletion biased electrodes.

Upon the completion of the integration time (during the vertical blanking interval of commercial television), the charge signals which have accumulated (a "field"), are transferred in parallel in the column direction from the A register to the B register by the application of multiple phase voltages. The charges are subsequently transferred, a row at a time, from the B register to the C register, and as each row of charges reaches the C register, it is serially shifted out of the C register in response to the proper shift voltages. The serial shifting of the C register occurs at relatively high speed (during the "line time" of commercial television). During the transfer of the field from the B to the C register, a new field may be integrated in the A register.

In the above-described structure, the CCD is located at the focal plane of the image intensifier tube and disposed substantially orthogonal to the optical axis of the tube. As shown in FIG. 1, the CCD is attached to a metal holder plate having an aperture therethrough that permits electrons emitted from the photocathode to impinge upon the imaging A register of the CCD. The electron impervious body of the holder plate masks the B storage register and the C horizontal output register from electron bombardment which would induce spurious charge in the B and C registers. A ceramic header, shown in elevation in FIG. 3, comprises a ceramic base member and a ceramic plate. The base member has a rectangular aperture slightly larger than the CCD (not shown). The base member aperture is not centered about the optical axis of the tube but is displaced to one side of the axis so that the A register of the CCD, when attached to the holder plate, may be centered about the optical axis. Two columns of metalized contact pads, with 12 pads in each column, are formed on the surface of the base member opposite the surface which is attached to the holder plate. The contact pads extend radially outward from the rectangular aperture and terminate at opposite parallel sides of the base beyond the vacuum envelope of the camera tube. The ceramic plate is fused to the base member of the header structure in such a manner that a portion of the contact pads are disposed between the two ceramic members. The ceramic plate has a substantially circular central aperture with an inside diameter substantially greater than the diameter of the rectangular aperture formed in the base member. The plate thus provides adequate room to electrically connect bonding wires between the 24 CCD electrodes along the periphery of the CCD and the 24 contact pads adjacent the header aperture. The outer edge of the ceramic plate terminates outside the vacuum envelope a distance from the edge of the header thus allowing adequate room to externally contact the radially extending contact pads.

In the above-described structure, the spatial information is limited by the size of the A register to about 82,000 pixels. The spatial information can be increased to about 164,000 pixels by eliminating the B storage register and using both the A and B registers as image registers. A proposed new CCD chip having 457 columns and 572 rows will provide about 234,000 imaging pixels in the combined A and B registers.

In some applications, such as spectroscopy, the entire spatial information capacity of the A and B registers is not required and only a portion of the A and B regisers, for example, an area constituting only a single column of 512 pixels, is used.

Regardless of whether the imaging area comprises the entire A and B registers or only a portion thereof, it is necessary that the imaging area be centered about the optical axis to minimize and equalize the pincushion distortion which is characteristic of an inverter image sensor. To this end, a header assembly is required that permits the sensor to be operated in one of a plurality of possible preselected modes, while masking the nonimaging portion of the CCD from electron emission from the photocathode of the sensor.

SUMMARY OF THE INVENTION

An intensified charge coupled image sensor comprises an inverter image intensifier tube having an evacuated envelope with a longitudinally extending optical axis. The sensor has a photoemissive cathode and a charge coupled device spaced from the cathode. The charge coupled device includes an imaging area, an output register and a plurality of electrodes disposed on a surface of said device. The charge coupled device is resiliently held by securing means attached to a surface of a header means. The securing means has an imaging aperture therethrough that exposes a portion of the imaging area of the charge coupled device to electrons emitted from the cathode. The charge coupled device is disposed within a header aperture extending through the header means. The header means also has an electrode surface with a plurality of discrete electrode pads thereon. The plurality of electrode pads exceeds the number of electrodes required for the operation of the charge coupled device. Bonding means electrically connect the electrodes of the charge coupled device to selected ones of the electrode pads.

DETAILED DESCRIPTION OF THE PREFERRED EMBODIMENT

Figure 4:
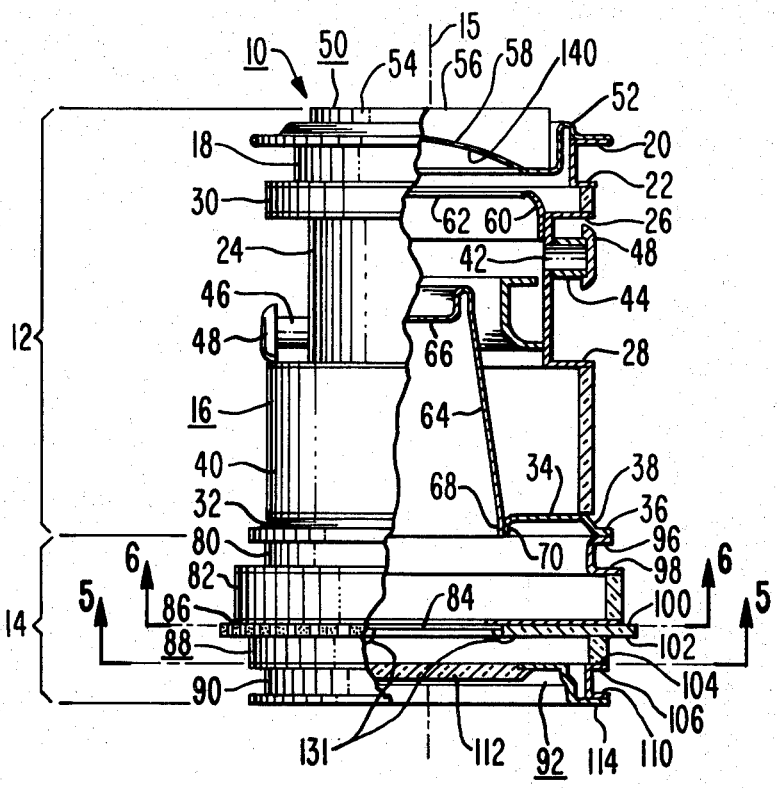
FIG. 4 is an elevation view, partially in section, of an intensified charge coupled image sensor having a novel universal header assembly.

An intensified charge coupled image sensor 10 is shown in FIG. 4. The sensor 10 comprises an inverter image intensifier section, generally indicated as 12 and a universal header assembly, generally designated as 14. An optical axis, 15, extends longitudinally along the center line of the sensor 10.

The image intensifier section 12 comprises a substantially cylindrical vacuum envelope 16 which may be of glass-metal or ceramic-metal construction. For maintaining close dimensional tolerances, ceramic-metal construction is preferred. As shown in FIG. 4, the intensifier section 12 includes a conductive annular cathode bulb flange 18 of generally U-shaped cross section. The bulb flange 18 has a substantially flat radially extending weld lip 20 and a substantially flat radially extending sealing lip 22. Spaced from the cathode bulb flange 18 is the grid bulb flange 24. The grid bulb flange 24 is a conductive member having a pair of substantially flat, radially extending sealing surfaces 26 and 28, respectively, at the ends thereof. An insulating spacer 30 is disposed in vacuum-tight relation between the sealing lip 22 and the sealing surface 26. Spaced from the sealing surface 28 of the grid flange 24 is a conductive anode bulb support member 32. The anode bulb support member 32 comprises a substantially flat annular sealing surface 34 and a radially extending anode weld flange 36. A truncated conical support portion 38 extends between the annular sealing surface 34 and the radially extending anode weld flange 36 of the anode bulb support member 32. An insulating anode spacer 40 is disposed in vacuum-tight relation between sealing surface 28 of the grid flange 24 and the flat annular sealing surface 34 of the anode bulb support member 32.

A plurality of access apertures 42, only one of which is shown, extend through the body of the grid bulb flange 24. The purpose of the access apertures will be discussed hereinafter. The vacuum integrity of the envelope 16 is maintained by brazing a plurality of copper tubulations 44 and 46, respectively, into the flange 24 surrounding the apertures 42. The tubulations 44 and 46 are shown as being "tipped-off", i.e., cold welded by crimping. A tip-off protector 48 is attached to the end of each of the "tipped-off" tubulations 44 and 46 to protect the tipoff from damage.

A cathode faceplate assembly 50 seals one end of the envelope 16. The cathode faceplate assembly 50 includes a cathode faceplate flange 52 and a cathode faceplate 54. The faceplate 54 is sealed to the faceplate flange 52 by a method well known in the art to form a vacuum seal. The cathode faceplate 54 is shown as having a planar exterior surface 56 and a concave interior surface 58.

An internally disposed grid electrode 60, having a centrally located grid aperture 62, is attached, for example by brazing, to the interior of the grid flange 24. An anode cone 64, having a centrally disposed cone aperture 66, is spaced from the grid electrode 60. The anode cone 64 has a proximal end 68 attached, for example by welding, to a longitudinally extending lip 70 formed along the inner periphery of the anode support member 32.

The novel universal header assembly 14 comprises, in combination, a header assembly bulb flange 80, a header assembly spacer 82, a charge coupled device (CCD) 84, a holder plate 86, a universal header 88, a header weld flange 90 and a header window assembly 92.

The header assembly bulb flange 80 is a generally cylindrical metal member having a U-shaped cross section with a radially extending header weld flange 96 at one end and a spacer sealing flange 98 at the other end. The header weld flange 96 is heliarc welded around its periphery to the anode weld flange 36. The header assembly spacer 82 is an insulating member disposed in vacuum-tight relation between the spacer sealing flange 98 of header assembly bulb flange 80 and the CCD holder plate 86. The universal header 88 comprises a multilayer insulating member, preferably a high alumina ceramic, having a first sealing surface 100, an electrode surface 102 and a second sealing surface 104. The conductive header assembly weld flange 90 has a U-shaped cross section with a radially extending sealing surface 106 at one end thereof disposed in vacuum-tight relation to the second sealing surface 104 of the header 88. A sealing surface 110 disposed at the other end of flange 90 is heliarc welded to the header window assembly 92 to complete the vacuum envelope. As shown in FIG. 4, the header window assembly 92 comprises a glass window 112 and a window sealing flange 114. The purpose of the window will be discussed hereinafter.

Figure 5:
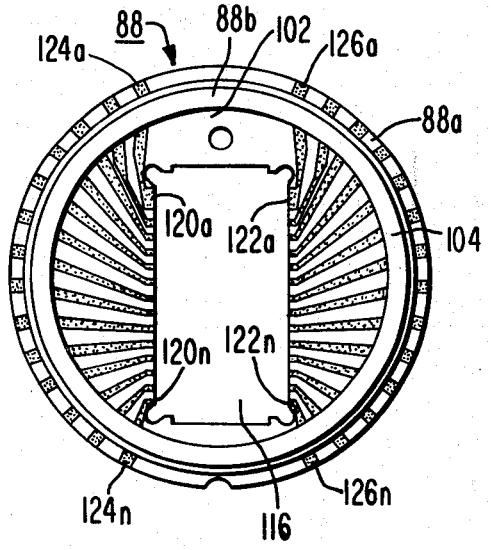
FIG. 5 is an enlarged elevation view of a universal header along lines 5—5 of FIG. 4.

As shown in FIG. 5, the universal header 88 is formed by a multilayer lamination and sintering process that forms a strong, hermetic, dimensionally stable and thermally inert member. The process is known in the art and need not be described in detail. Alternatively, the header may be formed by joining two discrete ceramic components using a glass frit seal of epoxy bond. The header 88 comprises a substantially flat ceramic disc 88*a* having a rectangularly-shaped aperture 116 formed therethrough. The width dimension of the aperture is centered about the optical axis 15; however, the center of the length dimension is slightly offset with respect to the optical axis 15 by about 0.075 inches (1.84 mm). The outer diameter of the disc is substantially greater than the outside diameter of the sensor envelope 16. One surface of the disc, designated as a first sealing surface 100, is the sealing surface which, as shown in FIG. 4, is sealed, for example by brazing, to one surface of the CCD holder plate 86. The sealing surface 100 is metallized by a method described in detail in U.S. Pat. No. 3,290,171 issued to Zollman, et al. on Dec. 6, 1966 and entitled, "Method and Materials for Metallizing Ceramics", which is incorporated by reference herein. The metallized surface is subsequently nickel plated, prior to brazing, by a method well known in the art. The surface 102 of the disc opposite the first sealing surface 100 comprises the electrode surface. The electrode pattern is formed in the multilayer structure by stacking in layers a ceramic substrate having an external and internal electrically conductive pattern. The layers are separated by a high purity ceramic and sealed by sintering. The present novel structure provides two columns of electrode pads. A total of 14 pads, designated 120*a–n* are in one column and 14 pads, designated 122*a–n* are in the second column. The pads comprise refractory metal such as, for example, molybdenum or any equivalent material known in the art. The pads 120*a–n* and 122*a–n* extend from the periphery of the rectangularly-shaped aperture 116 to the outer edge of the disc 88*a* terminating in electrical contacts 124*a–n* and 126*a–n*, respectively. A sufficient contact area is provided adjacent to the outer edge of the header 88 to permit electrical connections to be made to the contacts 124 and 126. The contact surface may be increased by extending the contacts 124 and 126 longitudinally along a portion of the outer edge of the disc 88*a*. The header 88 also includes an insulating ring 88*b* formed by stacking layers of annular ceramic substrates on the electrode surface 102 of the disc 88*a* in such a manner that the contacts 124 and 126 are sealed between the ring 88*b* and the disc 88*a*. The ring 88*b* terminates in the second sealing surface 104.

Figure 3:
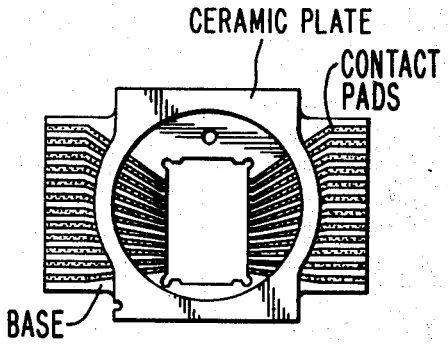
Fig. 3 PRIOR ART
FIG. 3 is an enlarged elevation view of the prior art header along lines 3—3 of FIG. 1.

A comparison of the prior art header shown in FIG. 3 and the present novel header shows that the length of the rectangular aperture 116 of the present header is longer by about 0.1 inch (2.45 mm) than the prior art header aperture and that the present header aperture is more nearly centered, along its length, than the prior art aperture which is displaced from the optical axis by about 0.129 inches (3.16 mm). The greater length of the present header aperture 116 thus permits the number of contact pads 120*a–n* and 122*a–n* in each column of pads to be increased from 12 in the prior art to 14 on the present header 88. On the present header 88 the first pads 120*a* and 122*a* in each of the two columns of pads have larger bonding areas (about 2.29×1.02 mm) adjacent to the aperture 116 than do the remaining pads. The larger area of the pads 120*a* and 122*a* permit the use of a bulk getter (not shown) which has a high current-carrying capability. Getter tabs (not shown) may be brazed to the pads 120*a* and 122*a* permitting the getter to be welded therebetween. Of course, if the getter is not used, for example when the A and B registers of the CCD 84 are centered about the optical axis, the pads 120*a* and 120*b* may be used for connections to the CCD 84. The first pads 120*a* and 122*a* are located on about 2.29 mm centers from the second pads 120*b* and 122*b*, respectively. The remaining pads, 120*b–n* and 122*b–n* having bonding areas of about 0.76×0.51 mm spaced on about 1.52 mm centers. By increasing the length of the aperture 116, relocating the aperture toward the center of the header 88, and increasing the number of contact pads from 12 per column to 14 per column, only one header 88 is required for any desired imaging configuration or mode of operation. While only 24 of the 28 contact pads 120*a–n* and 122*a–n* are used in any one configuration, increasing the total number of contact pads from 24 and 28 simplifies the interconnection process by providing contact pads immediately adjacent to the electrodes on the CCD 84 and permits centering of the imaging area of the CCD about the optical axis.

Figure 6:
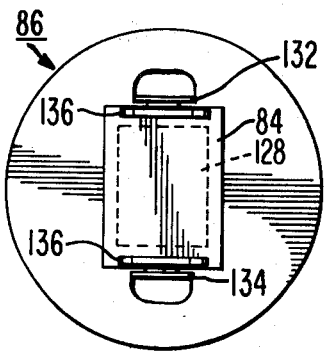
FIG. 6 is an enlarged view of a preferred CCD holder plate along line 6—6 of FIG. 4.

In the preferred embodiment, the entire A and B registers of the CCD 84 are used as imaging registers and are centered about the optical axis of the tube. The CCD holder plate 86, shown in FIG. 6, is used to secure and position the CCD 84. The apertured area of the holder plate 86 defined by imaging aperture 128, is shown in phantom. The width dimension of the imaging aperture 128 may be decreased until only a single column of 512 pixels (not shown) comprises the apertured imaging area.

Figure 7:
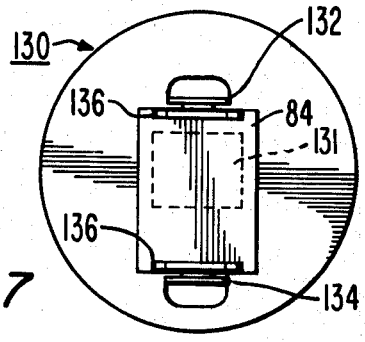
FIG. 7 is an enlarged elevation view of an alternative CCD holder plate.

In an alternative embodiment equivalent to the prior art structure discussed in the background of the invention, a CCD holder plate 130, shown in FIG. 7, replaces holder plate 86. In this configuration only the A register of the CCD 84 is used for imaging. The apertured portion of the holder plate 130 defined by an imaging aperture 131 is shown in phantom. The B and C registers are masked by the electron impervious portion of the holder plate 130. In this configuration, the first two contact pads in each column of FIG. 5, 120*a*, 120*b* and 122*a*, 122*b*, respectively, are not used for CCD connections. The larger pads, 120*a* and 122*a*, are available for attaching getter mounting tabs thereto, as described above.

In either the preferred or the alternative embodiments, the electrodes of the CCD 84 are connected to selected ones of the contact pads 120*a–n* and 122*a–n* by means of bonding wires 131.

Each of the CCD holder plates 86 and 130 has a pair of supports 132 and 134 struck from the body of the holder plates and extending orthogonally therefrom. A support spring 136 is welded to the inboard side of each of said supports. The springs 136 contact the charge coupled device 84 beyond the active area of the device. One spring 136 contacts the device adjacent to the A register and the other spring 136 contacts the device 84 adjacent to the C register. The CCD 84 is resiliently retained substantially orthogonal to the optical axis 15, of the sensor 10.

The charge coupled device 84 may be either a surface channel device or a buried channel device. Both devices are well known in the art and need not be described. If a surface channel device 84 is utilized, a transparent window 112 is sealed into the header weld flange 90 of the CCD vacuum header assembly 14 to provide a means for bias lighting the CCD. Bias lighting is described in U.S. Pat. No. 3,925,657 to Levine, issued on Dec. 9, 1975 and incorporated by reference herein for disclosure purposes. The window 112 may also be used to simultaneously photon image a scene onto the surface of the CCD, 84, opposite the electron imaging surface. The simultaneous or coincidence imaging of photons on one surface of the CCD and electrons on the other surface may be done with either a surface channel or buried channel CCD, although a buried channel device is preferred for its greater dynamic range.

The sensor 10 is activated by forming a photoemissive cathode 140 on the interior surface 58 of the cathode faceplate 54. Electrical connection between the cathode 140 and the cathode bulb flange 18 is provided by an annular ring of aluminum (not shown) that bridges the faceplate flange interface. The photocathode 140 may be one of any number of photoemissive surfaces known in the art. For many applications where extended red response is desirable, a potassium-sodium-cesium-antimony photocathode is preferred. Briefly, the cathode is formed by baking the sensor 10 at an elevated temperature for several hours while one of the tubulations, for example 44, is connected to an exhaust system (not shown) for removing occluded gases from the tube components. The tube is then cooled to room temperature at which time the activation process is initiated. The process may, for example, be similar to that described in U.S. Pat. No. 3,658,400 issued to F. A. Helvy on Apr. 25, 1972 and entitled, "Method Of Making A Multialkali Photocathode With Improved Sensitivity To Infrared Light And A Photocathode Made Thereby". The Helvy patent is incorporated by reference herein for disclosure.

Figure 1:
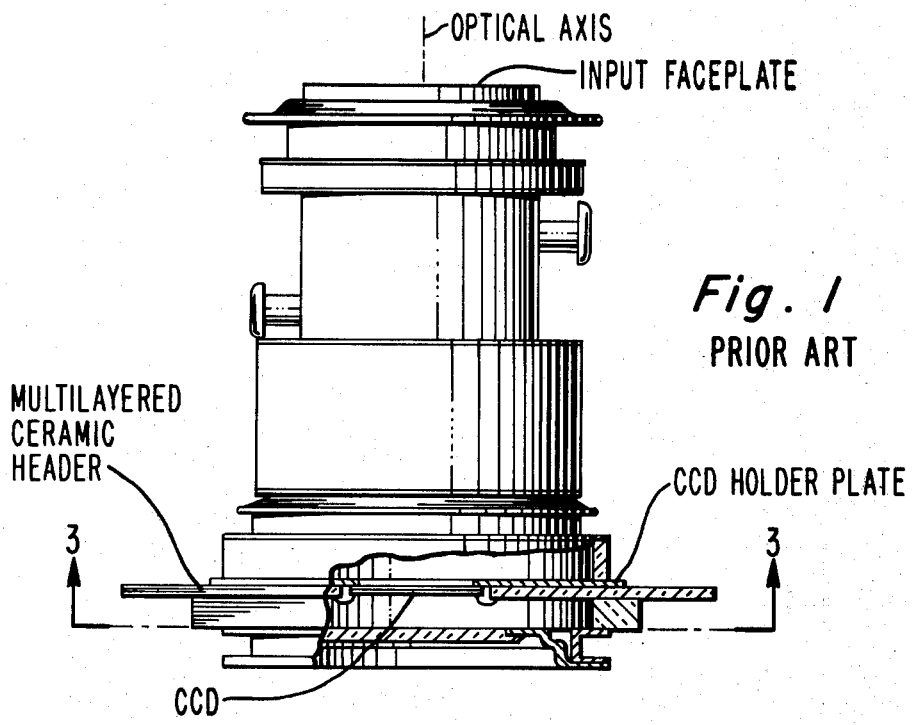
Fig. 1 PRIOR ART
FIG. 1 is an elevation view, partially in section, of a prior art intensified charge coupled image sensor.
Figure 2:
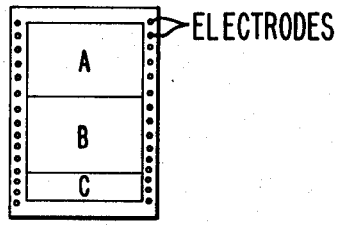
FIG. 2 is a schematic representation of a three phase operated CCD imager.

Subsequent to cathode formation and "tipoff", the image tube section of the sensor 10 may be operated by applying a negative potential, e.g., about −12 kV, to the cathode 140 by means of flange 18. A potential positive with respect to cathode potential, e.g., ground potential, may be applied to anode bulb support member 32. A focus potential, which in the unipotential tube of FIG. 1, is cathode potential, may be applied to the grid electrode 60 by means of the grid flange 24. The grid potential may also be made negative with respect to the cathode potential if it is desired to terminate the flow of electrons from the photocathode 140. The operating potentials applied to the CCD 84 are those recommended by manufacture, typically ranging from about −15 to +15 volts with respect to ground.

An alternative method of operation may be achieved by applying a positive potential, such as +2 kV, to the anode with the cathode 140 and the CCD 84 having the potentials described above applied thereto. In this alternative method of operation, the sensor will demagnify the image of the cathode on the CCD from about unity to about 0.4. Image demagnification permits the use of the full photocathode diameter (which is 18 mm for the tube shown in FIGS. 1 and 4) without the loss of information from the outer periphery of the photocathode.

To one skilled in the art, it should be apparent that by locating a microchannel plate (not shown) in proximity to the CCD, 84, between the CCD and the photocathode 140, the gain of the sensor 10 may be increased.

What is claimed is:

1. An intensified charge coupled image sensor of the type comprising:

(a) an inverter image intensifier tube including:

(1) an evacuated envelope having a longitudinally extending optical axis, and (2) a photoemissive cathode within said envelope for emitting electrons in a pattern corresponding to the intensity of radiation incident thereon, and (b) a universal header assembly comprising:

(1) a charge coupled device spaced from said cathode and disposed in a plane substantially orthogonal to said optical axis, said charge coupled device having an imaging area, an output register and a plurality of electrodes disposed on a surface of said device, said electrodes providing means for operating said sensor in one of a number of preselected modes, (2) header means having a header aperture therethrough, said header aperture having a center slightly displaced in at least one dimension from said optical axis, said header means further having an electrode surface with a plurality of discrete electrode pads thereon, said plurality of electrode pads exceeding the number of electrodes required for the operation of said charge coupled device in any one of said number of preselected modes, (3) securing means disposed between said cathode and said charge coupled device for resiliently holding said charge coupled device, said securing means being attached to a surface of said header means opposite said electrode surface so that said charge coupled device is disposed within said header aperture of said header means, said securing means further having an imaging aperture therethrough that exposes at least a portion of the imaging area to said electron emission from said cathode, and (4) bonding means for electrically connecting said electrodes of said charge coupled device to selected ones of said electrode pads.

2. An intensified charge coupled image sensor of the type comprising:

(a) an inverter image intensifier tube including:

(1) an evacuated envelope having a longitudinally extending optical axis, and (2) a photoemissive cathode within said envelope for emitting electrons in a pattern corresponding to the intensity of radiation incident thereon, and (b) a universal header assembly comprising:

(1) a charge coupled device spaced from said cathode and disposed in a plane substantially orthogonal to said optical axis, said charge coupled device having an imaging area including an A register and a B register, said charge coupled device further including an output register and a plurality of electrodes disposed on a surface of said device, (2) header means having a header aperture therethrough, said header aperture having a center slightly displaced in at least one dimension from said optical axis, said header means further having an electrode surface with a plurality of discrete electrode pads thereon, said plurality of electrode pads exceeding the number of electrodes required for the operation of said charge coupled device, (3) securing means disposed between said cathode and said charge coupled device for resiliently holding said charge coupled device, said securing means being attached to a surface of said header means opposite said electrode surface so that said charge coupled device is disposed within said header aperture of said header means, said securing means further having an imaging aperture therethrough that exposes at least a portion of the imaging area of said A and said B registers to said electron emission from said cathode, and (4) bonding means for electrically connecting said electrodes of said charge coupled device to selected ones of said electrode pads.

3. An image sensor as in claim 2 wherein said header aperture is sufficiently large so as to permit said imaging area of said charge coupled device to be centered within said header aperture with respect to said optical axis.

4. An image sensor as in claim 3 wherein said imaging aperture of said securing means is centered with respect to said optical axis.

5. An image sensor as in claim 4 wherein said imaging aperture of said securing means exposes to electron emission a portion of said imaging area of said A register and said B register comprising one column having a length of 512 pixels.

6. An image sensor as in claim 4 wherein said imaging aperture of said securing means exposes all of said imaging area comprising said A register and said B register to electron emission, said imaging area comprising about 164,000 pixels.

7. An image sensor as in claim 2 wherein said center of said header aperture is slightly displaced from said optical axis by about 1.84 mm in said one dimension.

8. An image sensor as in claim 2 wherein said plurality of electrode pads comprise two columns of refractory metal pads with 14 pads in each of said columns.

9. An image sensor as in claim 8 wherein said refractory metal pads extend from the periphery of said header aperture to an outer edge of said header means, said pads terminating in 28 electrical contacts at said outer edge of said header means.

10. An image sensor as in claim 9 wherein said first pad in each of said two columns of pads has a bonding area adjacent to said header aperture larger than the bonding area of each of said remaining pads.

11. An image sensor as in claim 9 wherein said header means includes a universal header comprising a substantially flat ceramic disc having said header aperture therethrough, and an annular ceramic ring bonded to said electrode surface of said disc.

12. An image sensor as in claim 11 wherein said electrical contacts extend between annular ring and said disc.

13. An image sensor as in claim 12 wherein said electrical contacts extend longitudinally along said outer edge of disc.

14. An image sensor as in claim 2 wherein said universal header assembly further including a header window assembly for completing the vacuum enclosure.

15. An image sensor as in claim 2 wherein said securing means comprises a holder plate, said holder plate having a pair of supports struck from the body of the plate and extending orthogonally therefrom.

16. An image sensor as in claim 15 wherein said securing means further includes a support spring bonded to each said supports, each of said springs being in contact with said charge coupled device.

* * * * *